US012123260B2

(12) United States Patent
Purcell

(10) Patent No.: US 12,123,260 B2
(45) Date of Patent: Oct. 22, 2024

(54) DRILL BIT ASSEMBLY FOR FLUID-OPERATED PERCUSSION DRILL TOOLS

(71) Applicant: Mincon International Limited, Shannon (IE)

(72) Inventor: Joseph Purcell, Ennis (IE)

(73) Assignee: MINCON INTERNATIONAL LIMITED, Shannon (IE)

( * ) Notice: Subject to any disclaimer, the term of this patent is extended or adjusted under 35 U.S.C. 154(b) by 6 days.

(21) Appl. No.: 17/780,121

(22) PCT Filed: Nov. 24, 2020

(86) PCT No.: PCT/EP2020/083185
§ 371 (c)(1),
(2) Date: May 26, 2022

(87) PCT Pub. No.: WO2021/105109
PCT Pub. Date: Jun. 3, 2021

(65) Prior Publication Data

US 2023/0003086 A1 Jan. 5, 2023

(30) Foreign Application Priority Data

Nov. 28, 2019 (IE) ..... 2019/0203

(51) Int. Cl.
*E21B 10/36* (2006.01)
*E21B 17/07* (2006.01)

(52) U.S. Cl.
CPC ..... *E21B 10/36* (2013.01); *E21B 17/076* (2013.01)

(58) Field of Classification Search
CPC ..... E21B 10/36; E21B 17/076
See application file for complete search history.

(56) References Cited

U.S. PATENT DOCUMENTS 4,241,800 A * 12/1980 Stenuick ..... E21B 17/07 175/417
4,862,976 A * 9/1989 Meek ..... E21B 17/076 175/417

(Continued)

FOREIGN PATENT DOCUMENTS

GB 2530318 A * 3/2016 ..... E21B 10/36
KR 20200032708 A * 3/2020 ..... E21B 4/14

(Continued)

OTHER PUBLICATIONS

International Search Report from corresponding International Patent Application No. PCT/EP2020/083185, dated Feb. 1, 2021.

(Continued)

*Primary Examiner* — Jennifer H Gay
(74) *Attorney, Agent, or Firm* — KUSNER & JAFFE

(57) ABSTRACT

The present invention relates to a drill bit assembly for fluid-operated percussion drill tools. The drill bit assembly comprises a percussion bit having a head portion formed with an axially extending shank, a first plurality of axially extending splines on the shank slideably engageable with a first plurality of complementary splines formed internally of a drive chuck whereby rotational drive from the chuck may be transmitted to the shank. The assembly also comprises engagement means on the chuck adapted for connecting the chuck to a drive means of the fluid-operated percussion drill tool. During drilling, the bit and the chuck are held in a first relative orientation in which the bit is retained in the chuck, and the bit is moveable axially relative to the chuck to a bit removal position, in which the bit is rotatable relative to the chuck to a second relative orientation in which the bit is removable from the chuck. The bit is moveable to the bit removal position while the chuck is fully engaged with the drive means.

13 Claims, 14 Drawing Sheets

(56) References Cited

U.S. PATENT DOCUMENTS

| | | | | |
|---|---|---|---|---|
| 4,919,221 | A * | 4/1990 | Pascale | E21B 17/046 173/132 |
| 6,705,415 | B1 | 3/2004 | Falvey et al. | |
| 6,789,632 | B2 * | 9/2004 | Green | E21B 17/076 175/300 |
| 8,347,988 | B2 * | 1/2013 | Gilbert | E21B 17/076 175/414 |
| 8,550,189 | B2 * | 10/2013 | Wolfer | E21B 10/36 408/239 R |
| 10,041,309 | B2 * | 8/2018 | Bruandet | E21B 4/14 |
| 2004/0016574 | A1 | 1/2004 | Green | |
| 2007/0137895 | A1 * | 6/2007 | Marshall | E21B 17/076 175/57 |
| 2010/0252330 | A1 * | 10/2010 | Gilbert | E21B 4/06 175/293 |
| 2010/0263932 | A1 * | 10/2010 | Wolfer | B23B 31/113 175/57 |
| 2010/0264608 | A1 * | 10/2010 | Wolfer | E21B 17/076 279/19 |
| 2011/0155471 | A1 * | 6/2011 | Wolfer | E21B 17/046 408/239 R |
| 2012/0145464 | A1 * | 6/2012 | Gien | E21B 10/36 175/414 |
| 2013/0008722 | A1 | 1/2013 | Gilbert et al. | |
| 2014/0367173 | A1 | 12/2014 | Cooper | |
| 2014/0367175 | A1 * | 12/2014 | Cooper | E21B 10/36 175/414 |
| 2016/0340983 | A1 * | 11/2016 | Bruandet | E21B 4/14 |
| 2017/0241213 | A1 * | 8/2017 | Boswell | E21B 17/046 |
| 2023/0003086 | A1 * | 1/2023 | Purcell | E21B 17/076 |

FOREIGN PATENT DOCUMENTS

| | | | | |
|---|---|---|---|---|
| WO | WO-2017/188876 | A1 | 11/2017 | |
| WO | WO-2020016137 | A1 * | 1/2020 | E21B 10/36 |
| WO | WO-2020051637 | A1 * | 3/2020 | |

OTHER PUBLICATIONS

Written Opinion of the International Search Authority from corresponding International Patent Application No. PCT/EP2020/083185, dated Feb. 1, 2021.

International Preliminary Report on Patentability of the International Preliminary Examining Authority from corresponding International Patent Application No. PCT/EP2020/083185 dated Oct. 13, 2021.

* cited by examiner

DRILL BIT ASSEMBLY FOR FLUID-OPERATED PERCUSSION DRILL TOOLS

FIELD OF THE INVENTION

The present invention relates to a drill bit assembly for fluid-operated percussion drill tools. In particular, the invention concerns a drill bit assembly for use with down-the-hole hammers.

BACKGROUND TO THE INVENTION

Conventional down-the-hole hammers and fluid-operated percussion drill tools typically comprise an external cylinder or outer wear sleeve, within which is mounted an inner cylinder which in turn engages with a backhead assembly. A sliding reciprocating piston co-operates with the inner cylinder and backhead assembly, so that when air pressure is supplied through the backhead assembly, the piston acts with a percussive effect on a drill bit retained within a chuck screw-threadably connected to the bottom of the outer wear sleeve. The bit shank is formed externally with a plurality of axially-extending splines which are spaced around the circumference of the bit shank. The splines on the bit slideably engage with complementary splines formed on the internal wall of the chuck for transfer of rotational drive from the chuck to the bit.

In traditional arrangements, to retain the bit in the chuck, a bit retaining ring may be provided, which sits above the chuck and cooperates with an annular shoulder on the bit. In alternative arrangements, a portion of the bit retaining ring adapted to engage the retaining shoulder to retain the bit in the assembly is disposed within the chuck. Typically, the bit retaining ring is provided in two halves, which are held together by an O-ring.

In each of these existing arrangements, removal of the bit from the assembly requires that the chuck be unscrewed from the outer wear sleeve so that the bit can be removed from the chuck. When the chuck is unscrewed from the outer wear sleeve, the bit retaining ring is removed and the bit drops out. A new bit is then placed inside the chuck, the bit retaining ring is placed on the end of the chuck so that it engages a shoulder or tail splines on the bit shank and the O-ring is placed on the bit retaining ring to hold it together. This assembly is then reattached to the hammer by screwing the chuck into the wear sleeve. A disadvantage of this arrangement is that unscrewing the chuck from the hammer is time-consuming. Down-the-hole hammers are typically designed such that the screw-threaded connection between the chuck and the wear sleeve is tightened during drilling. Breaking out the thread to replace the bit can be difficult due to the extremely high torque used to tighten the connection before and during drilling, and may require specialist break-out equipment. In aggressive ground conditions, it could be necessary to remove the bit many times during the life cycle of the hammer for replacement or regrinding. Furthermore, drilling crews are often paid per metre drilled, and time spent changing drill bits reduces the amount of time which can be spent drilling.

It is therefore desirable to provide a drill bit assembly from which the bit can be removed without requiring the chuck to be unscrewed from the wear sleeve. One such arrangement is proposed in Irish Patent No. S87041, in which a retaining sleeve is mounted externally on the chuck. The retaining sleeve is moveable between a drilling position, in which the bit and the chuck are retained in a first relative orientation, and a bit removal position, in which the bit is rotatable relative to the chuck to a second relative orientation in which the bit is removable from the chuck. However, issues can arise in relation to flushing of the retention sleeve and it is therefore desirable to provide a simpler and more robust construction.

SUMMARY OF THE INVENTION

The present invention relates to a drill bit assembly for fluid-operated percussion drill tools, comprising:

- a percussion bit having a head portion formed with an axially extending shank, a first plurality of axially extending splines on the shank slideably engageable with a first plurality of complementary splines formed internally of a drive chuck whereby rotational drive from the chuck may be transmitted to the shank; and
- engagement means on the chuck adapted for connecting the chuck to a drive means of the fluid-operated percussion drill tool; and
- wherein, during drilling, the bit and the chuck are held in a first relative orientation in which the bit is retained in the chuck, and the bit is moveable axially relative to the chuck to a bit removal position, in which the bit is rotatable relative to the chuck to a second relative orientation in which the bit is removable from the chuck, and wherein the bit is moveable to the bit removal position while the chuck is fully engaged with the drive means, that is, while the chuck is in its operating position.

The bit removal position of the bit may be an axial position, or range of axial positions, in which the bit is rotatable relative to the chuck.

An advantage of this arrangement is that because the bit can be moved axially to the bit removal position while the chuck is in its operating position, that is, without requiring the engagement means on the chuck to be disconnected from the percussion drill tool, the bit can be removed from the drill bit assembly without requiring that the chuck be unscrewed from the wear sleeve. This increases the speed at which drill bits can be replaced, thereby maximising drilling time. Specialist break-out equipment is also not required for removal or replacement of the bit. Because a separate retaining sleeve is not required to maintain the bit and the chuck in the first relative orientation, issues associated with flushing of such a retaining sleeve are avoided.

The drill bit assembly may further comprise alignment means on the bit engageable with complementary alignment means on the chuck to prevent rotation of the bit relative to the chuck such that the bit and the chuck are held in the first relative orientation in which the bit is retained in the chuck, and wherein, in the bit removal position, the alignment means are disengaged from the complementary engagement means such that the bit is rotatable relative to the chuck to the second relative orientation.

The complementary alignment means may comprise a set of axially extending alignment splines formed internally of the chuck at a forward end thereof and the alignment means may comprise one or more sets of axially extending alignment splines formed at a forward end of the bit shank, such that the alignment splines on the chuck are engageable with at least one of the sets of alignment splines on the bit shank to retain the bit and the chuck in the first relative orientation. In the bit removal position, the alignment splines on the chuck are disengaged from the one or more sets of alignment splines on the bit shank, to permit rotation of the bit relative to the chuck to the second relative orientation.

A circumferential portion of the bit shank, corresponding in axial length to at least a length of at least one of the alignment splines on the chuck and located adjacent the one or more sets of alignment splines, may be unsplined and, in the bit removal position, the alignment splines on the chuck may be registered with the unsplined portion of the bit shank to permit rotation of the bit relative to the chuck. The bit removal position is therefore determined by appropriate placement of the unsplined portion of the bit shank during design of the drill bit assembly. An advantage of this arrangement is that the bit removal position may be selected such that inadvertent movement of the bit to the bit removal position during drilling is unlikely.

Suitably, when the bit and the chuck are in the first relative orientation, bit retaining means on the bit engages with complementary bit retaining means on the chuck to retain the bit in the chuck, and when the bit and the chuck are in the second relative orientation, the bit retaining means is disengaged from the complementary bit retaining means to allow the bit to be removed from the chuck.

The drill bit assembly may comprise at least one retention spline at a rear end of the bit shank, wherein when the bit and the chuck are in the first relative orientation, the or each retention spline is arranged to engage a rear end of a corresponding one of the first complementary splines formed internally of the chuck to retain the bit in the chuck. The at least one retention spline may thus constitute the bit retaining means.

When the bit and the chuck are in the second relative orientation, the at least one retention spline may be offset from the complementary splines formed internally of the chuck to allow the bit to be removed from the chuck. At least one edge of the at least one retention spline may be radially offset from a corresponding edge of a corresponding one of the first plurality of splines on the bit shank.

The drill bit assembly may further comprise an aligner bushing arranged rearwardly of the drive chuck, whereby the aligner bushing is adapted to engage the at least one retention spline to prevent rotation of the bit relative to the aligner bushing when the bit is in the bit removal position. The aligner bushing may comprise at least one spline formed internally thereof and engageable with the at least one retention spline on the bit shank to prevent rotation of the bit relative to the aligner bushing when the bit is in the bit removal position. The aligner bushing may be dimensioned such that a frictional force associated with a fit between an outer surface of the aligner bushing and an inner surface of a wear sleeve of the fluid-operated percussion drill tool prevents rotation of the aligner bushing relative to the wear sleeve during normal operation of the hammer, thereby preventing rotation of the bit relative to the chuck. For example, a transition fit, such as a locational transition fit may be provided between the aligner bushing and the wear sleeve. However, the bit is rotatable relative to the chuck to the second relative orientation upon application of a rotational force between the bit and wear sleeve sufficient to overcome the frictional force associated with the fit between the aligner bushing and the wear sleeve of the fluid-operated percussion drill tool.

The rotational force may be applied by the fluid-operated percussion drill tool or by hand, using an appropriate hand-held tool. For example, where the bit removal position requires the hammer to be pushed fully into the hammer, the force may be applied by pushing the hammer into the ground, so that the bit is held stationary, and driving the hammer in a reverse direction to normal operation to cause a counter-rotation between the aligner bushing and the wear sleeve (and thus between the bit and the chuck). Where the bit removal position is a position intermediate a position where the bit is fully extended and a position in which the bit is pushed fully into the hammer, the rotational force may be applied by applying a slight counter-rotational force to the bit as it is pulled out of the hammer. When the alignment splines on the chuck disengage from the alignment splines on the bit shank, a higher force may be applied to the bit to rotate the bit and the aligner bushing relative to the wear sleeve and the chuck, to move the bit and the chuck into the second relative orientation.

Thus, if the bit moves axially into the bit removal position during normal drilling operation, the bit is prevented from rotating relative to the aligner bushing. Because the aligner bushing is tightly fitted into the wear sleeve, and thus rotationally fixed relative to the wear sleeve and chuck under normal operating conditions, this means that rotation of the bit relative to the chuck to the second relative orientation is also prevented. The bit (and aligner bushing) are only rotatable relative to the wear sleeve (and thus the chuck) by application of a rotational force sufficient to overcome the friction between the aligner bushing and the wear sleeve. Thus, accidental relative rotation of the bit and chuck into the second relative orientation during drilling (and thus accidental release of the bit from the chuck) is avoided.

According to another aspect of the present invention, there is provided a down-the-hole hammer comprising an external cylindrical outer wear sleeve, a sliding piston mounted for reciprocating movement within the outer wear sleeve to strike a percussion bit of a drill bit assembly located at the forward end of the outer wear sleeve, wherein the drill bit assembly is an assembly as described above.

DETAILED DESCRIPTION OF THE DRAWINGS

Figure 1:
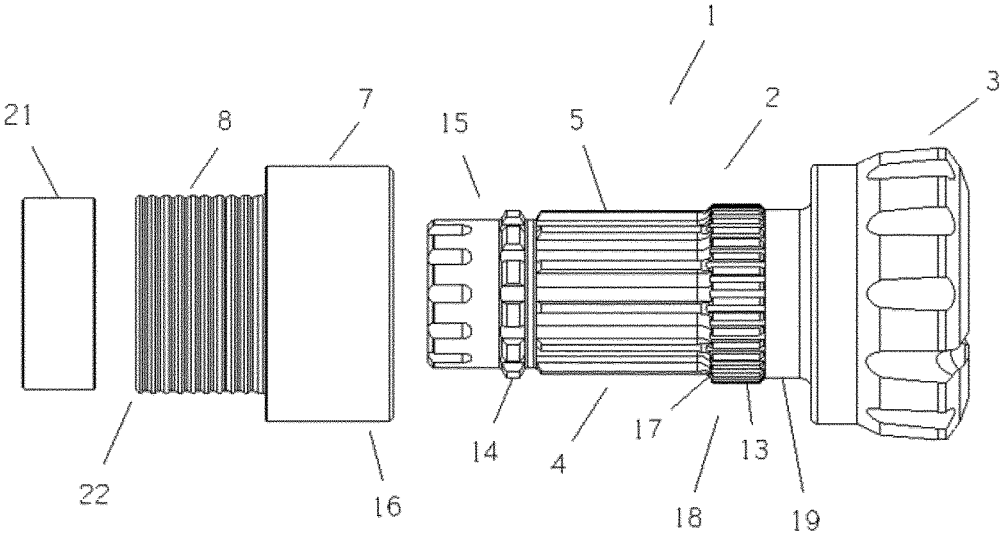
FIG. 1 is an exploded view of a drill bit assembly according to a first embodiment of the present invention.

A first embodiment of a drill bit assembly 1 for fluid-operated percussion drill tools, according to the present invention is illustrated in FIGS. 1 to 7.

The assembly comprises a percussion bit 2 having a head portion 3 formed with an axially extending shank 4. A first plurality of axially extending splines 5 spaced around the circumference of the bit shank 4 are slideably engageable with a first plurality of complementary splines 6 formed internally of a drive chuck 7 whereby rotational drive from the chuck may be transmitted to the shank. A screw-thread 8 is provided on the chuck 7 adapted for connecting the chuck 7 to a drive means of the fluid-operated percussion drill tool.

A second plurality of splines 14, referred to as retention splines, is provided at a rear end 15 of the bit shank. As shown most clearly in FIG. 1, each of the retention splines 14 is wider than the corresponding one of the first plurality of splines 5, so that one edge of each spline 14 is offset from the edge of corresponding spline 5. The spacing between the splines of the first plurality of internal splines 6 on the drive chuck is wide enough to accommodate one of the second plurality of splines 14 on the bit shank. As shown most clearly in FIGS. 1 and 2, a third plurality of splines 13, referred to as alignment splines, is formed around an outer circumference of an outwardly directed shoulder 17 at a forward end 18 of the bit shank, adjacent the bit head 3.

Figure 2:
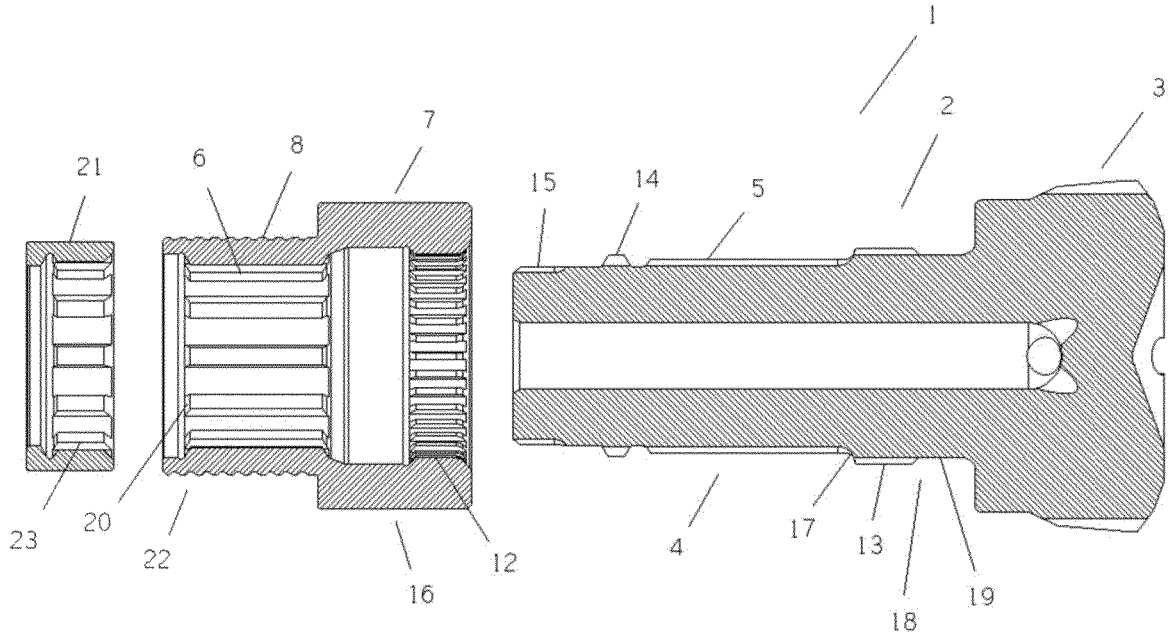
FIG. 2 is a longitudinal cross-sectional view of the drill bit assembly of FIG. 1.
Figure 3:
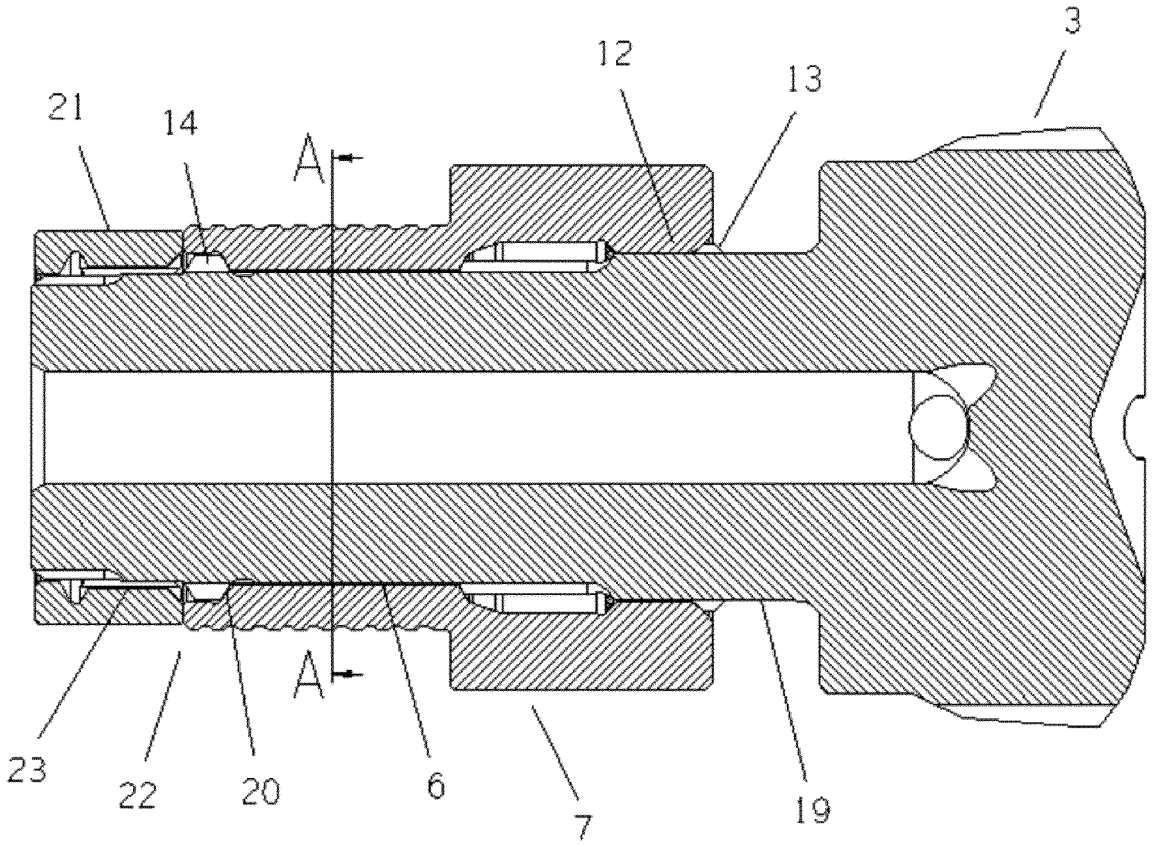
FIG. 3 is a longitudinal cross-sectional view of the drill bit assembly of FIG. 1, assembled, with the bit and the chuck in the first relative orientation.

As shown most clearly in FIG. 2, a second plurality of splines 12, referred to as alignment splines, is formed internally of the drive chuck at a forward end 16 thereof. During drilling, as shown in FIG. 3, the alignment splines 12 on the chuck are arranged to engage with the alignment splines 13 on the bit shank, thereby preventing rotation of the bit relative to the chuck. The bit 2 and the chuck 7 are thereby retained in a first relative orientation shown in FIG. 5, in which each of the tail splines 14 is arranged to engage a rear end 20 of a corresponding one of the splines 6 formed internally of the chuck 7 to retain the bit in the chuck. The bit is therefore retained in the chuck during drilling operation of the fluid-operated percussion drill tool.

As also shown in FIGS. 1 and 2, a circumferential portion 19 of the bit shank, which corresponds in axial length to a length of the alignment splines 12 on the chuck with a small clearance, and which is located adjacent the one or more sets of alignment splines 13 on the bit, is unsplined. When the bit is moved axially relative to the chuck to the bit removal position shown in FIG. 4 (which in this embodiment requires the bit to be pushed fully into the hammer), the alignment splines 12 on the chuck are registered or aligned with the unsplined portion 19 of the bit shank so that they are disengaged from the alignment splines 13 on the bit shank. This allows the bit to be rotated relative to the chuck to a second relative orientation shown in FIG. 6. In this orientation, the retention splines 14 are offset from the complementary splines 6 formed internally of the chuck so that they no longer engage the rear ends 20 of the complementary splines 6. The second plurality of splines 14 and the spacing between the internal splines 6 on the chuck are dimensioned such that, when the bit and the chuck are in the second relative orientation, the bit can be slid out of the assembly without unscrewing the chuck from the drill tool. As the bit is only limited in its axial movement in a rearward direction by the interaction of the bit head 3 with the chuck 7, the bit may be pushed fully into the hammer while the chuck is fully engaged with the wear sleeve. It is not necessary to unscrew the chuck from the wear sleeve in order to move the bit into the bit removal position.

Figure 8:
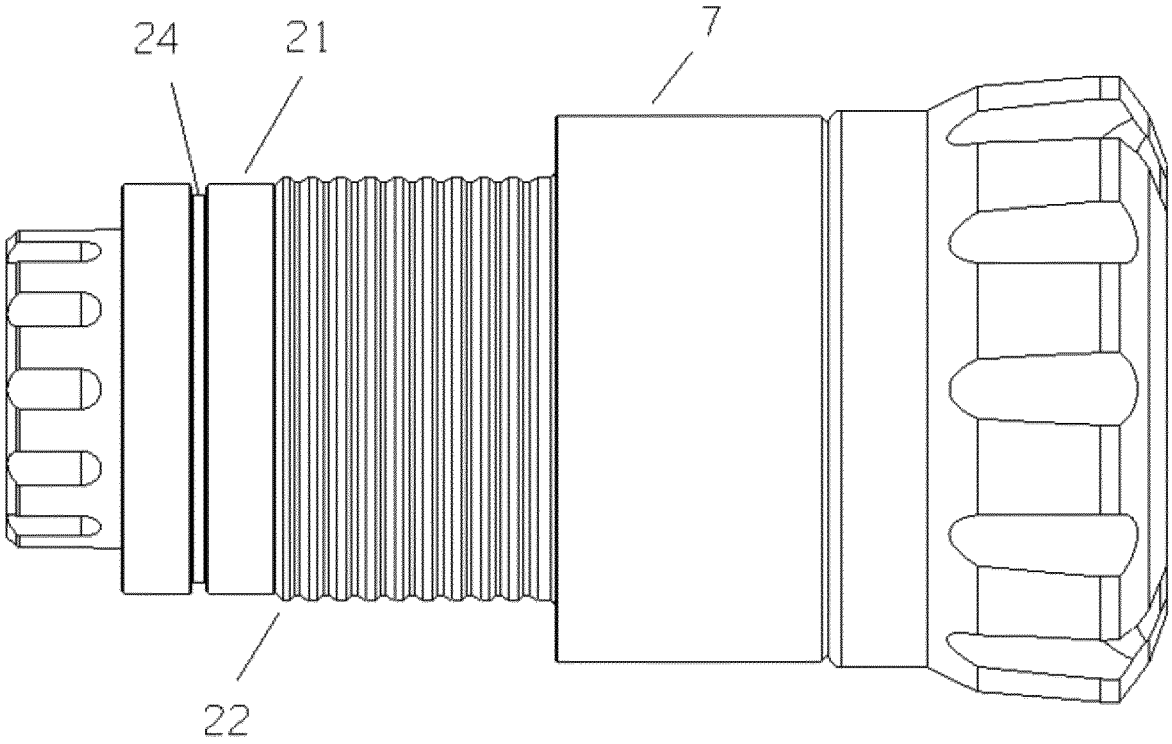
FIG. 8 is an elevation view of a drill bit assembly according to a second embodiment of the present invention.
Figure 9:
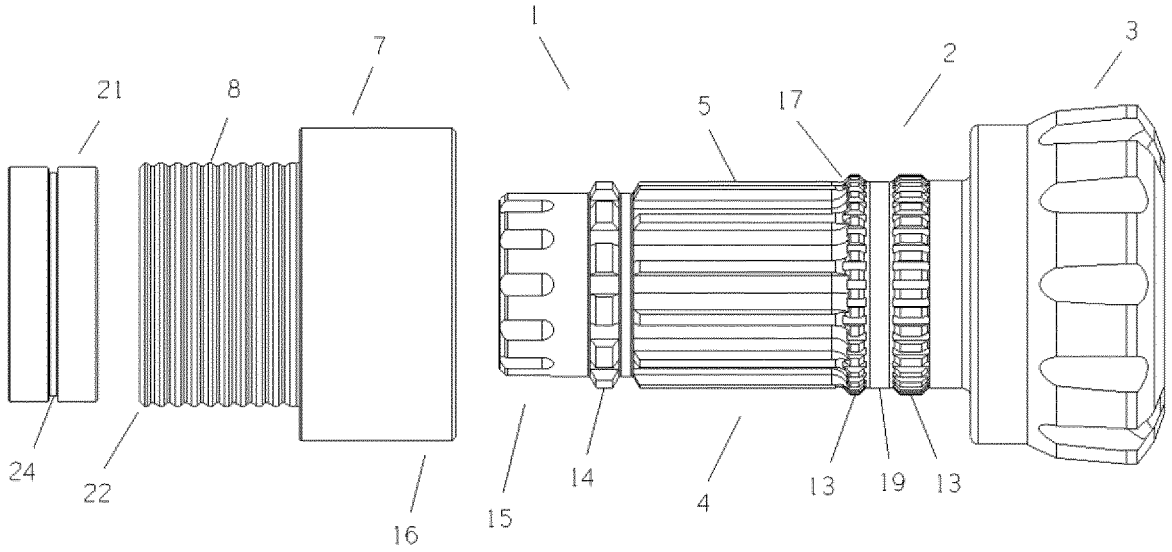
FIG. 9 is an exploded view of a drill bit assembly according to a third embodiment of the present invention.

As shown in FIGS. 1 to 7, the assembly further comprises an aligner bushing 21 arranged at a rear end 22 of the drive chuck. The aligner bushing comprises a plurality of splines 23 formed internally thereof and engageable with the retention splines 14 on the bit shank to prevent rotation of the bit relative to the aligner bushing when the bit is in the bit removal position. In this embodiment, the aligner bushing is dimensioned such that a locational transition fit is provided between an outer surface of the aligner bushing and an inner surface of a wear sleeve of the fluid-operated percussion drill tool. This may be achieved by dimensioning the aligner bushing such that its diameter is the same as or slightly larger than the internal diameter of the wear sleeve. In other embodiments, an appropriate fit may be achieved by way of a circumferential groove 24 in the outer surface of the aligner bushing as shown in FIG. 8, into which a hydraulic seal or O-ring may be fitted.

Figure 4:
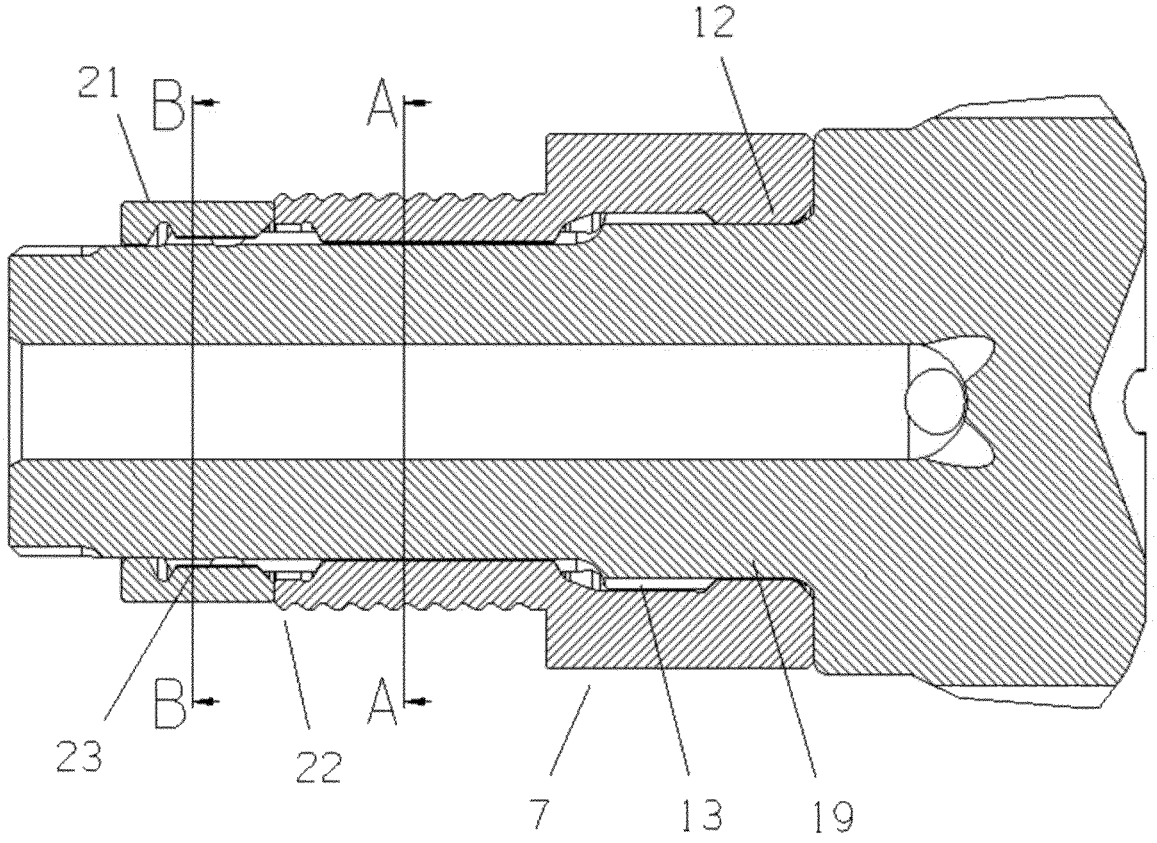
FIG. 4 is a longitudinal cross-sectional view of the drill bit assembly of FIG. 1, assembled, with the bit in the bit removal position.
Figure 5:
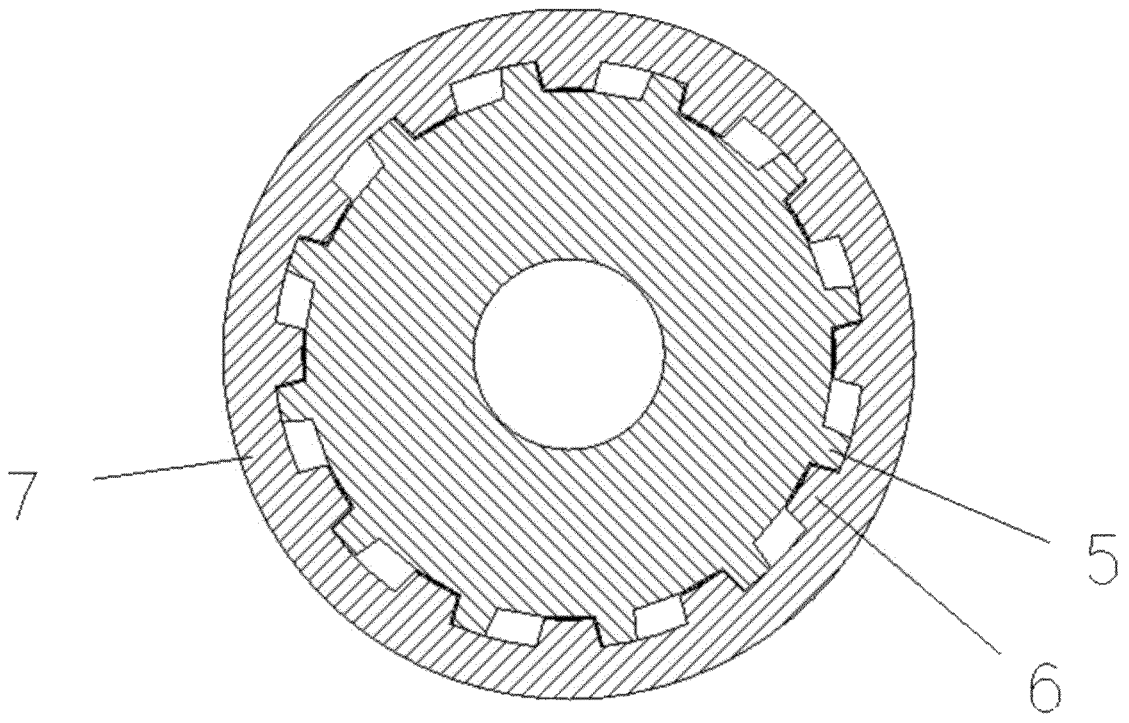
FIG. 5 is a transverse cross-sectional view of the drill bit assembly of FIG. 3, taken along line AA, in which the drill bit and chuck are in a first relative orientation in which the retention splines engage with splines formed internally of the chuck to retain the bit in the chuck.
Figure 6:
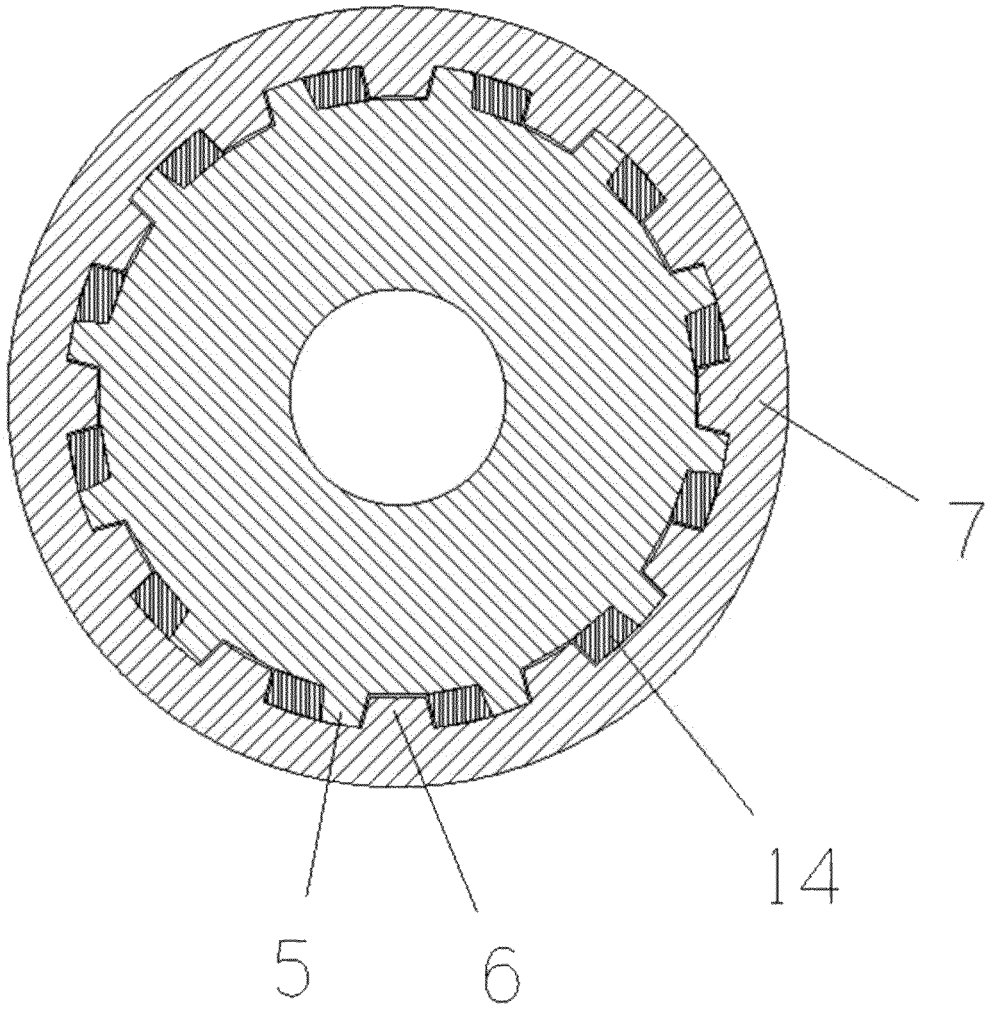
FIG. 6 is a transverse cross-sectional view of the drill bit assembly of FIG. 4, taken along line AA, in which the bit is in the bit removal position and the drill bit and chuck are in a second relative orientation in which retention splines on the bit are disengaged from the splines formed internally of the chuck to allow the bit to be removed from the chuck.
Figure 7:
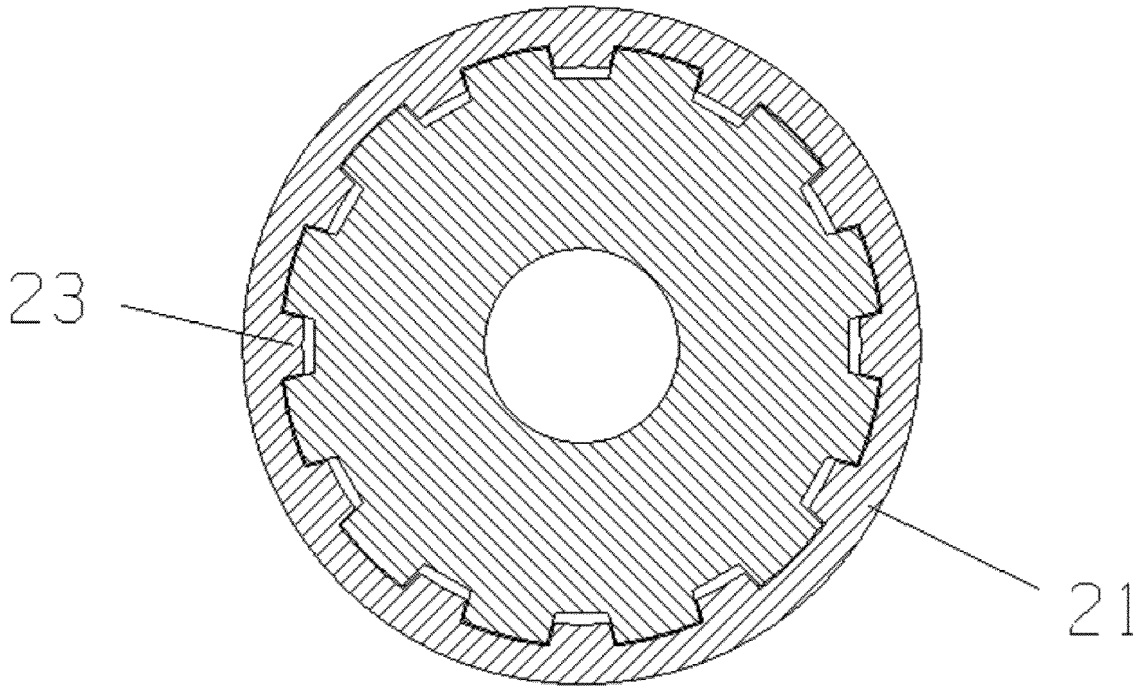
FIG. 7 is a transverse cross-sectional view of the drill bit assembly of FIG. 4, taken along line BB, in which the bit is in the bit removal position and splines on the aligner bushing are engaged with the retention splines on the bit to prevent rotation of the bit relative to the aligner bushing.

When the bit is in the bit removal position shown in FIG. 4, the bit is rotatable to the second relative orientation upon application of a rotational force sufficient to overcome the friction associated with the fit between the aligner bushing 21 and a wear sleeve of the fluid-operated percussion drill tool. For example, the hammer may be pressed into the ground, so that the bit is in the bit removal position and is prevented from rotating, and the hammer counter-rotated anti-clockwise (that is, in the opposite direction to normal operation of the hammer). In this way, torque from the drill string can overcome the frictional force associated with the fit between the aligner bushing and the wear sleeve, allowing the wear sleeve and chuck of the hammer to rotate relative to the bit and aligner into the second relative orientation. In this orientation, the bit can be slid out of the hammer and be switched or serviced without having to unscrew the chuck from the wear sleeve. Where the bit has a relatively small diameter, a pipe wrench could alternatively be used to rotate the bit and aligner bushing relative to the wear sleeve (and thus the chuck). Since, in this embodiment, the bit can only be rotated relative to the chuck when it is pushed fully into the hammer, thereby disengaging the secondary splines, the likelihood of the bit bouncing out of position during operation is extremely small.

Another embodiment of the invention is shown in FIGS. 9 to 14. This embodiment is similar to that shown in FIGS. 1 to 7. However, in this embodiment, two sets of alignment splines 13 are provided at the forward end 18 of the bit shank. An unsplined portion 19 is provided intermediate the two sets of alignment splines. Also, in this embodiment, the required fit between the aligner bushing 21 and a wear sleeve 25 of the percussion drill tool is achieved by way of a circumferential groove 24 in the outer surface of the aligner bushing, into which a hydraulic seal or O-ring 26 is fitted.

Figure 10:
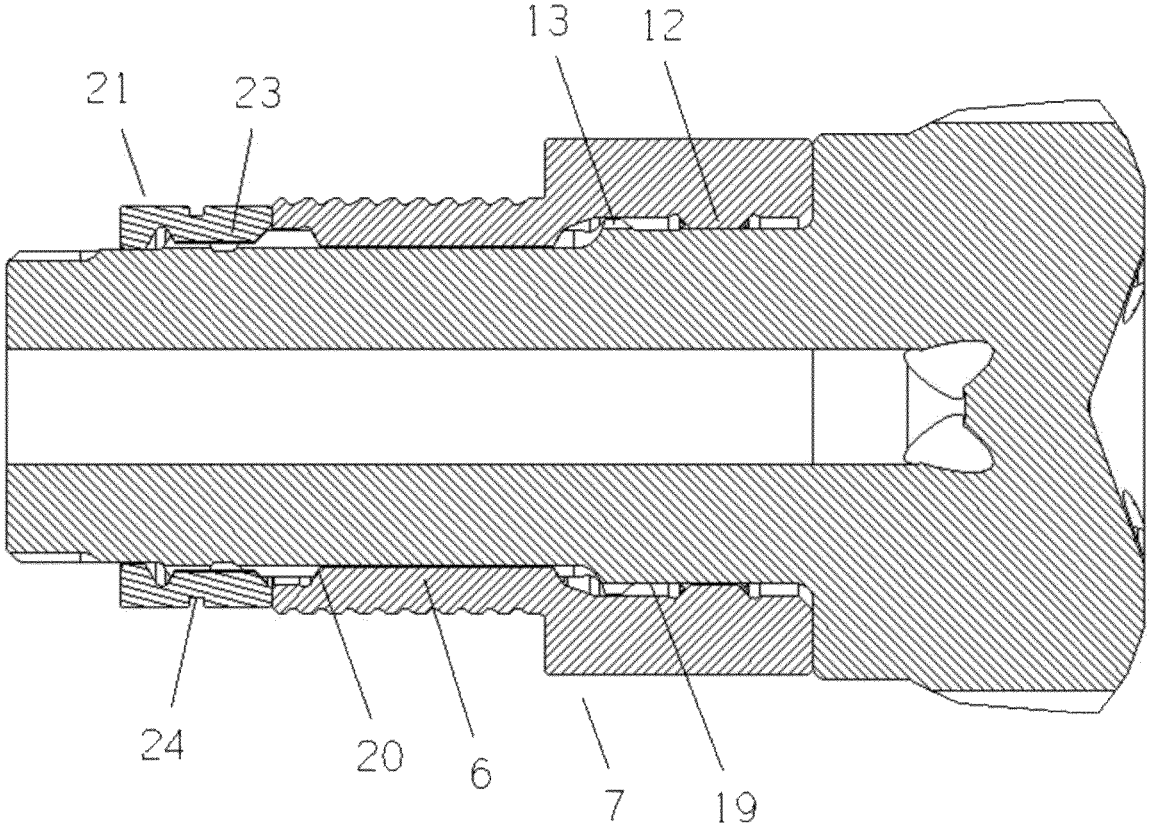
FIG. 10 is a longitudinal cross-sectional view of the drill bit assembly of FIG. 9, assembled, in which alignment splines on the chuck are engaged with a first set of alignment splines on the bit.
Figure 11:
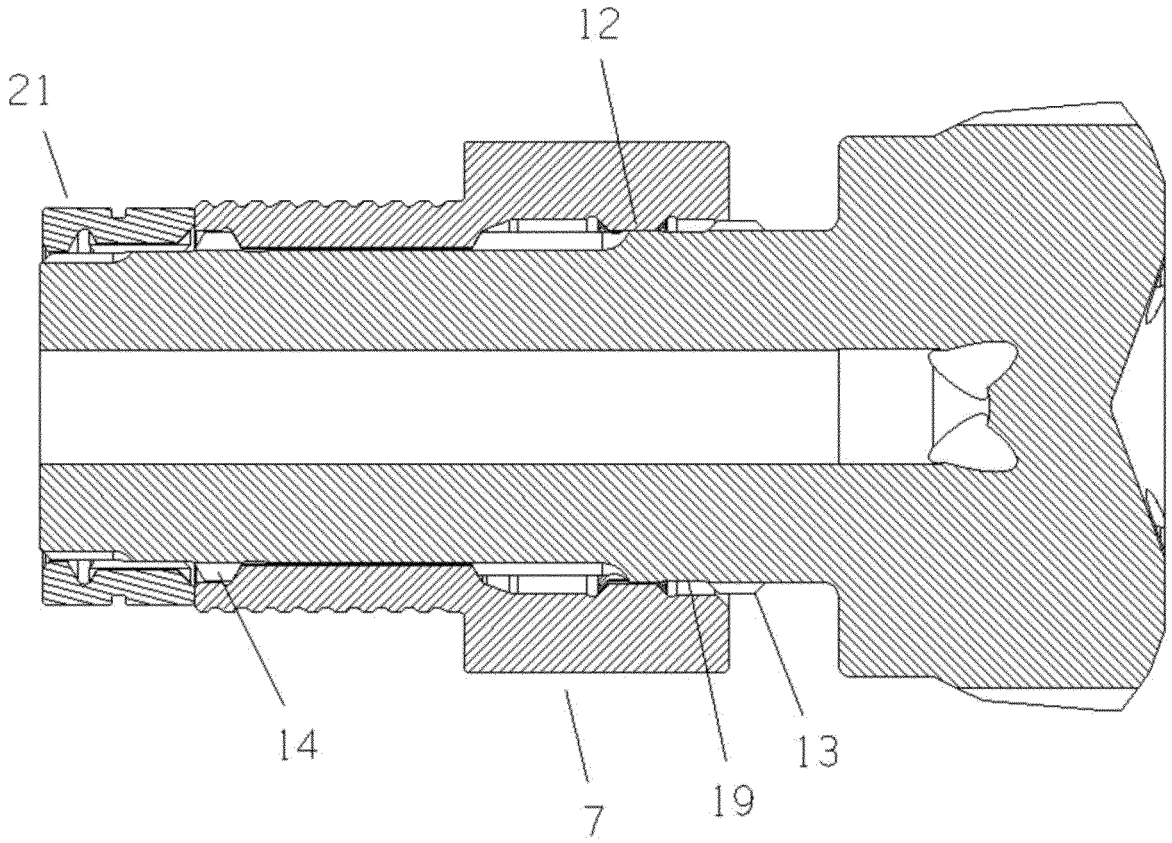
FIG. 11 is a longitudinal cross-sectional view of the drill bit assembly of FIG. 9, assembled, in which alignment splines on the chuck are engaged with a second set of alignment splines on the bit.

As shown in FIG. 10, when the bit is pushed fully into the hammer, the alignment splines 12 on the chuck engage a first set of the two sets of alignment splines 13 on the bit shank. As shown in FIG. 11, when the bit is fully extended, the alignment splines 12 on the chuck engage a second set of the two sets of alignment splines 13 on the bit shank. Thus, in each of these axial positions of the bit, the bit 2 and the chuck 7 are retained in a first relative orientation, in which each of the tail splines 14 is arranged to engage a rear end 20 of a corresponding one of the splines 6 formed internally of the chuck 7 to retain the bit in the chuck.

Figure 12:
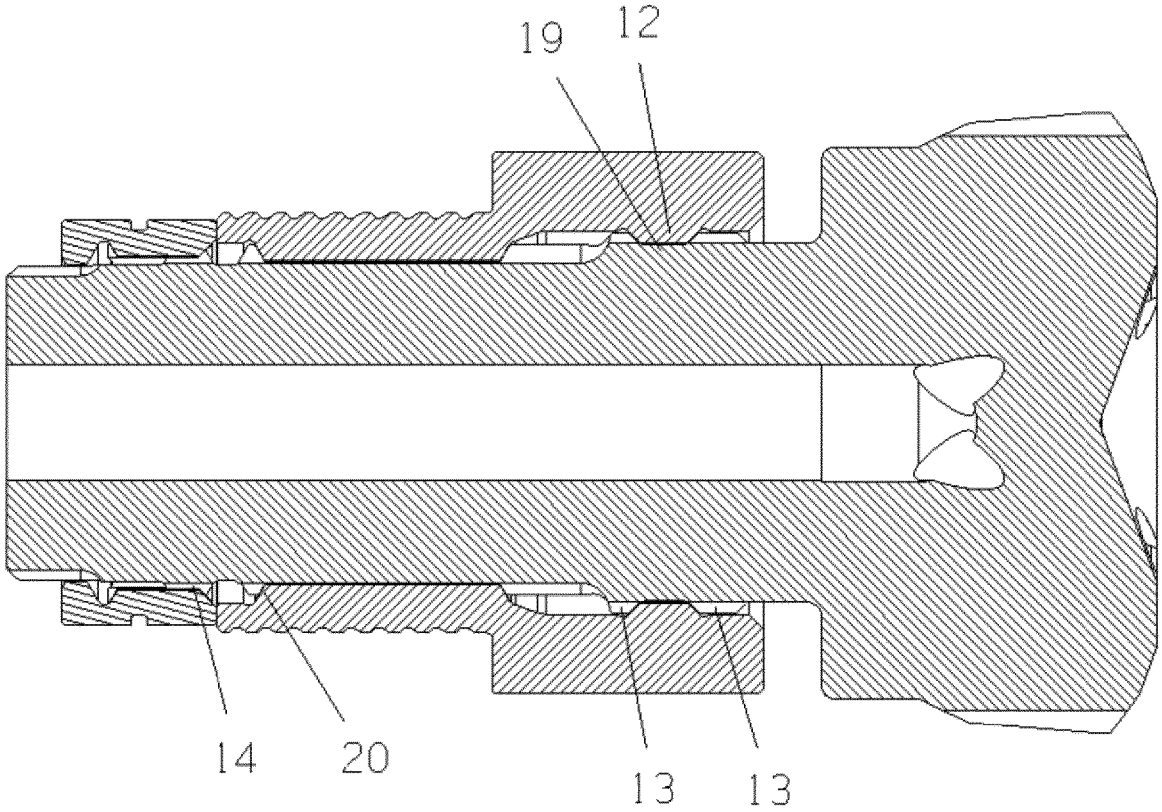
FIG. 12 is a longitudinal cross-sectional view of the drill bit assembly of FIG. 9, assembled, in which the bit is in the bit removal position.
Figure 13:
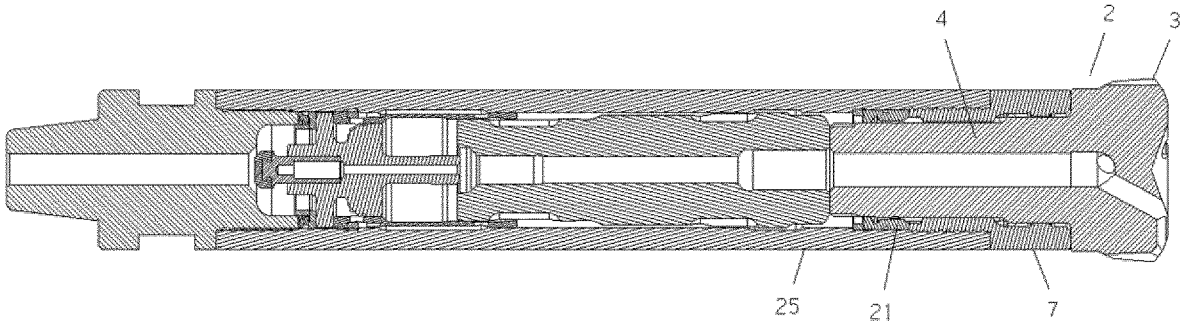
FIG. 13 is a longitudinal cross-section of a down-the-hole hammer comprising the drill bit assembly as shown in FIG. 10.
Figure 14:
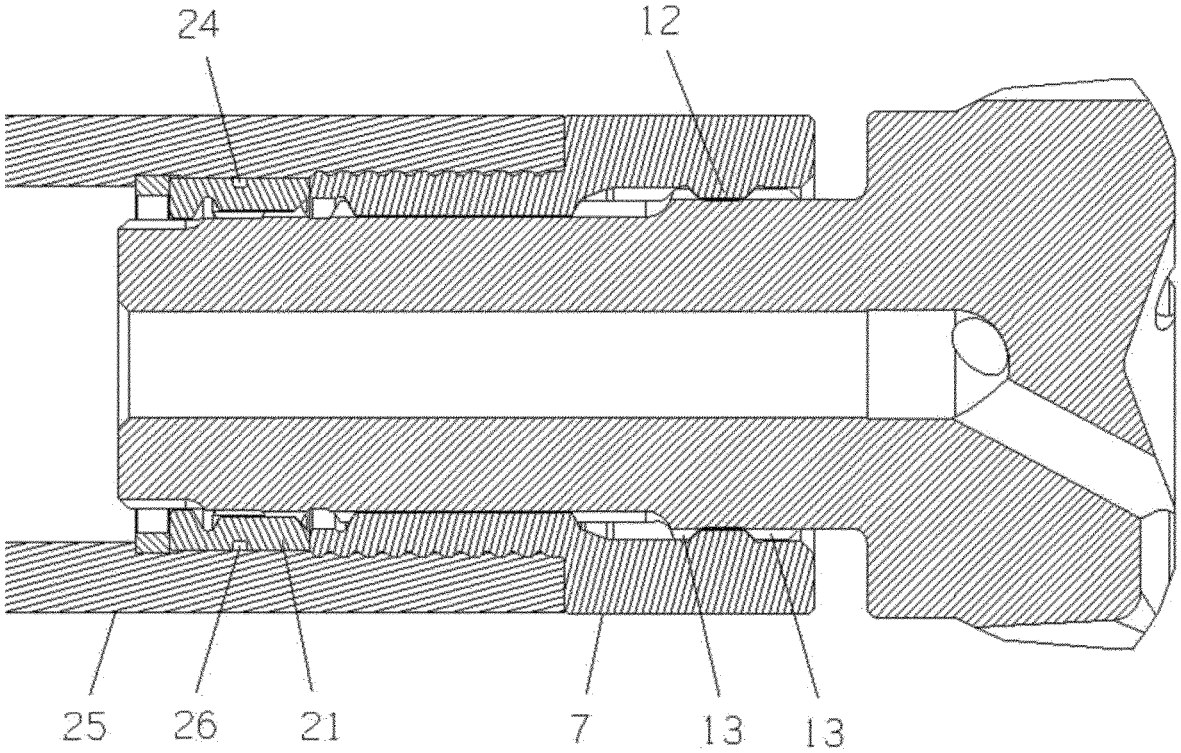
FIG. 14 is a partial longitudinal cross-section of the down-the-hole hammer of FIG. 13, with the bit in the bit removal position.

The bit removal position for this embodiment is shown in FIGS. 12 and 14. As shown in these figures, when the bit is in this position, the alignment splines 12 on the chuck are registered with the unsplined portion 19 of the bit shank, so that they are disengaged from both sets of alignment splines 13 on the bit shank. Thus, in this embodiment, the bit removal position is a position intermediate a position where the bit is fully extended (shown in FIG. 11) and a position in which the bit is pushed fully into the hammer (shown in FIGS. 10 and 13). In operation, to determine this intermediate bit removal position, a slight rotation pressure may be applied to the bit while pulling it out of the chuck. Once a 'click' is heard or felt, the splines have disengaged and the bit is then in the bit removal position. As the bit rarely spends any time in this position during operation, the likelihood of the bit rotating into the second relative orientation position during operation would be very small.

Once the bit is in the bit removal position, the bit may be rotated relative to the chuck, by application of a rotational force sufficient to overcome the frictional force associated with the fit between the aligner bushing 21 and the wear sleeve 25, to a second relative orientation in which the retention splines 14 are offset from the complementary splines 6 formed internally of the chuck so that they no longer engage the rear ends 20 of the complementary splines 6, and so the bit can be slid out of the assembly without unscrewing the chuck from the drill tool. As in the previous embodiment and as shown in FIG. 14, it is not necessary to unscrew the chuck from the wear sleeve in order to move the bit into the bit removal position.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A drill bit assembly for fluid-operated percussion drill tools, comprising:

a percussion bit having a head portion formed with an axially extending shank, a first plurality of axially extending splines on the shank slideably engageable with a first plurality of complementary splines formed internally of a drive chuck whereby rotational drive from the chuck is transmitted to the shank; and a screw thread on the chuck adapted for connecting the chuck to a drive means of the fluid-operated percussion drill tool; and alignment means on the bit engageable with complementary alignment means on the chuck to prevent rotation of the bit relative to the chuck such that the bit and the chuck are held in a first relative orientation in which the bit is retained in the chuck, wherein, in a bit removal position in which the bit is rotatable relative to the chuck to a second relative orientation in which the bit is removable from the chuck, the alignment means are disengaged from the complementary alignment means such that the bit is rotatable relative to the chuck to the second relative orientation, wherein, during drilling, the bit and the chuck are held in the first relative orientation in which the bit is retained in the chuck, and the bit is moveable axially relative to the chuck to the bit removal position, and wherein the bit is moveable to the bit removal position while the chuck is fully engaged with the drive means.

2. A drill bit assembly as claimed in claim 1, wherein the complementary alignment means comprises a set of axially extending alignment splines formed internally of the chuck at a forward end thereof and the alignment means comprises one or more sets of alignment splines formed at a forward end of the bit shank, such that the alignment splines on the chuck are engageable with at least one of the set of alignment splines on the bit shank to retain the bit and the chuck in the first relative orientation, and in the bit removal position, the alignment splines on the chuck are disengaged from the one or more sets of alignment splines on the bit shank, to permit rotation of the bit relative to the chuck to the second relative orientation.

3. A drill bit assembly as claimed in claim 2, wherein a circumferential portion of the bit shank, corresponding at least in axial length to a length of the alignment splines on the chuck and located adjacent the one or more sets of alignment splines on the bit, is unsplined and wherein, in the bit removal position, the alignment splines on the chuck are registered with the unsplined portion of the bit shank to permit rotation of the bit relative to the chuck.

4. A drill bit assembly as claimed in claim 1, further comprising at least one retention spline at a rear end of the bit shank, wherein when the bit and the chuck are in the first relative orientation, the or each retention spline is arranged to engage a rear end of a corresponding one of the complementary splines formed internally of the chuck to retain the bit in the chuck.

5. A drill bit assembly as claimed in claim 4, wherein when the bit and the chuck are in the second relative orientation, the at least one retention spline is offset from the complementary splines formed internally of the chuck to allow the bit to be removed from the chuck.

6. A drill bit assembly as claimed in claim 4 wherein at least one edge of the at least one retention spline is radially offset from a corresponding edge of a corresponding one of the first plurality of splines on the bit shank.

7. A drill bit assembly as claimed in claim 4, further comprising an aligner bushing arranged at a rear end of the drive chuck, whereby the aligner bushing is adapted to engage the at least one retention spline to prevent rotation of the bit relative to the aligner bushing when the bit is in the bit removal position.

8. A drill bit assembly as claimed in claim 7, wherein the aligner bushing comprises at least one spline formed internally thereof and engageable with the at least one retention spline on the bit shank to prevent rotation of the bit relative to the aligner bushing when the bit is in the bit removal position.

9. A drill bit assembly as claimed in claim 7, wherein the aligner bushing is dimensioned such that a frictional force associated with a fit between an outer surface of the aligner bushing and an inner surface of a wear sleeve of the fluid-operated percussion drill tool prevents rotation of the aligner bushing relative to the wear sleeve during normal operation of the hammer.

10. A drill bit assembly as claimed in claim 9, wherein the bit is rotatable to the second relative orientation upon application of a rotational force sufficient to overcome the frictional force associated with the fit between the aligner bushing and the wear sleeve of the fluid-operated percussion drill tool.

11. A drill bit assembly as claimed in claim 9, wherein the fit between the aligner bushing and the wear sleeve is a transition fit.

12. A drill bit assembly as claimed in claim 11, wherein the fit between the aligner bushing and the wear sleeve is a locational transition fit.

13. A down-the-hole hammer comprising an external cylindrical outer wear sleeve, a sliding piston mounted for reciprocating movement within the outer wear sleeve to strike a percussion bit of a drill bit assembly located at the forward end of the outer wear sleeve, wherein the drill bit assembly is an assembly as claimed in claim 1.

* * * * *